US006945040B2

(12) United States Patent
Kanno et al.

(10) Patent No.: US 6,945,040 B2
(45) Date of Patent: Sep. 20, 2005

(54) RAM MOVING METHOD FOR HYDRAULIC MACHINE, RAM MOVEMENT CONTROLLER, METHOD FOR PREVENTING TRAPPING OF AXIAL PLUNGER PUMP USED FOR THE MACHINE, AND THE PUMP

(75) Inventors: Kazuhiro Kanno, Kanagawa (JP); Nobuaki Ariji, Kanagawa (JP)

(73) Assignee: Amada Co., Ltd., Kanagawa (JP)

( * ) Notice: Subject to any disclaimer, the term of this patent is extended or adjusted under 35 U.S.C. 154(b) by 0 days.

(21) Appl. No.: 10/220,261

(22) PCT Filed: Mar. 2, 2001

(86) PCT No.: PCT/JP01/01626

§ 371 (c)(1),
(2), (4) Date: Dec. 10, 2002

(87) PCT Pub. No.: WO01/66341

PCT Pub. Date: Sep. 13, 2001

(65) Prior Publication Data

US 2003/0147757 A1 Aug. 7, 2003

(30) Foreign Application Priority Data

Mar. 7, 2000 (JP) ..... 2000-061645
Mar. 10, 2000 (JP) ..... 2000-067317

(51) Int. Cl.[7] ..... F15B 11/04
(52) U.S. Cl. ..... 60/431; 60/446
(58) Field of Search ..... 417/269, 12, 25, 417/26, 49.1, 62, 217, 291, 42, 326, 423.1, 572; 72/19.9; 100/269.1, 269.01; 60/431, 446

(56) References Cited

U.S. PATENT DOCUMENTS 3,810,715 A * 5/1974 Week et al. ..... 417/213
4,331,421 A * 5/1982 Jones et al. ..... 418/32
4,587,808 A 5/1986 Watanabe et al.
5,434,785 A 7/1995 Myeong-hün et al.

FOREIGN PATENT DOCUMENTS

| | | | | |
|---|---|---|---|---|
| JP | 58-166102 | | 10/1983 | |
| JP | 1-150500 | | 6/1989 | |
| JP | 01150500 | | 6/1989 | ..... B30B/15/20 |
| JP | 01150500 | A * | 6/1989 | ..... B30B/15/20 |
| JP | 03161200 | A * | 7/1991 | ..... B30B/15/18 |
| JP | 09295199 | A * | 11/1997 | ..... B30B/15/22 |
| JP | 2000-045929 | | 2/2000 | ..... F04B/1/22 |
| JP | 2000344442 | A * | 12/2000 | ..... B66B/9/04 |
| JP | 2001137948 | A * | 5/2001 | ..... B21D/5/02 |
| JP | 2001-137948 | | 5/2001 | ..... B21D/5/04 |

OTHER PUBLICATIONS

English language abstract of JP 1–150500 from Patent Abstracts of Japan, vol. 013, No. 441.
English language abstract of JP 58–166102 from Patent Abstracts of Japan, vol. 008, No. 002.
English Language Abstract for JP Appln. No. 01–150500.
English Language Abstract for JP Appln. No. 2001–137948.
English Language Abstract for JP Appln. NO. 2000–045929.

* cited by examiner

*Primary Examiner*—Michael Koczo
(74) *Attorney, Agent, or Firm*—Greenblum & Bernstein, P.L.C.

(57) ABSTRACT

If an instruction to move a ram (5U) is issued, a ram instructed speed is instructed to be suppressed to a certain warming-up speed not higher than a target speed until a release speed determination section (75) determines that a moving speed of the ram (5U) calculated by a ram moving speed calculation section (51) reaches a predetermined warming-up release speed; if the release speed determination section determines that the moving speed of the ram (5U) reaches the predetermined warming-up release speed, the warming-up speed is released to accelerate the ram (5U) to the target speed.

12 Claims, 7 Drawing Sheets

RAM MOVING METHOD FOR HYDRAULIC MACHINE, RAM MOVEMENT CONTROLLER, METHOD FOR PREVENTING TRAPPING OF AXIAL PLUNGER PUMP USED FOR THE MACHINE, AND THE PUMP

TECHNICAL FIELD

The present invention relates to a ram moving method in a hydraulic power unit which subjects a workpiece to pressing or the like by vertically moving a ram using a double acting cylinder which employs a two-way pump, a ram moving controller in the hydraulic power unit, a method for preventing a confinement phenomenon in an axial plunger pump, and the axial plunger pump, and more particularly relates to an axial plunger pump constituted to make a valve plate provided on an axial plunger pump, slightly rotatable.

BACKGROUND ART

In a hydraulic power unit which actuates a double acting cylinder using a two-way pump and thereby vertically moves a ram, the pressure of the double acting cylinder is in a negative pressure state when the cylinder starts moving the ram. Due to this, dead time occurs to the ram before actuating the two-way pump, supplying hydraulic oil to the double acting cylinder and moving the ram. Because of this ram dead time, a shock is generated on the ram. To avoid this shock phenomenon, the ram is warmed up.

According to a conventional hydraulic power unit ram moving method, therefore, if the movement of the ram is started according to a ram moving pattern, a speed distribution instruction to the ram is clamped at a predetermined speed for constant timer time before the moving speed reaches the highest speed, thereby warming up the ram.

However, the hydraulic power unit which employs such a two-way pump has a disadvantage in that ram dead time is not constant but varies depending on the operating state of the ram just before the dead time. That is, according to the ram moving method by utilizing constant timer time, a shock is generated because of too short timer time or, conversely, that time is adversely influenced by too long timer time.

Meanwhile, an axial plunger pump which is used as the two-way pump is constituted so that a cylinder block, which includes a plurality of plungers (pistons) provided therein to be able to be reciprocated, is rotatably disposed in a casing and that the rotation of this cylinder block reciprocates the plungers sequentially. The axial plunger pump is also constituted to suck hydraulic oil when each plunger gradually moves from a top dead center position (which is a position at which the plunger is in an engaged state in which the plunger is fitted into the cylinder block most deeply) to a bottom dead center position (which is a position at which the plunger is in an engaged state in which the plunger is fitted into the cylinder block most narrowly) and, conversely, to discharge the hydraulic oil when the plunger moves from the bottom dead center position to the top dead center position.

A valve plate which is fixedly provided in the casing to correspond to the cylinder block, is equipped with a circular arc-shaped suction port and a circular arc-shaped discharge port to correspond to the moving position in a plunger suction step and that in a plunger discharge step, respectively.

The suction port and the discharge port are provided to be slightly away from each other. A region between the suction port and the discharge port covers both the position which corresponds to the top dead center and the position which corresponds to the bottom dead center of the plunger. At the top dead center and bottom dead center of the plunger, a plunger insertion hole through which the plunger is inserted into the cylinder block is shielded, thereby causing a confinement phenomenon.

If the plunger is located at the bottom dead center position, the plunger is about to move to the discharge step and the pressure of the confined hydraulic oil is low. Due to this, the confinement phenomenon does not cause a significant problem. However, if the plunger is located at the top dead center position, the pressure of the confined hydraulic oil is high. If the plunger moves from the top dead center to a suction port side, pressure has great change, thereby causing vibration and noise.

To prevent the confinement phenomenon at the top dead center position of the plunger, there is proposed forming a notch, which communicates this confinement position with the discharge port, in the valve plate.

In the axial plunger pump, the rotation of the cylinder block is not limited to forward rotation but the cylinder block is sometimes rotated in a counter direction. In this case, the suction port and the discharge port change places with each other. Therefore, to prevent the confinement phenomenon, the above-stated notch can be provided in each of the suction port and the discharge port.

Nevertheless, the valve plate and the cylinder block are not located to be proximate to each other. Although depending on an operation state, a small distance of about 0.01 mm exists between the valve plate and the cylinder block. For that reason, the notch may cause the leakage of the hydraulic oil. If the notch is too large, pumping performance deteriorates. If the notch is too small, it does not sufficiently contribute to the prevention of vibration and that of noise. Thus, the axial plunger pump has a disadvantage in that it is difficult to form an appropriate notch.

The objects of this invention have been derived while paying attention to the above-stated technical disadvantages.

It is, therefore, the first object of the present invention to provide a ram moving method in a hydraulic power unit and a ram moving controller in a hydraulic power unit capable of moving a ram in shortest time without causing a shock even if the dead time of the ram changes.

It is the second object of the present invention to provide an axial plunger pump confinement prevention method and an axial plunger pump capable of effectively preventing vibration and noise.

DISCLOSURE OF THE INVENTION

To attain the above objects, a ram moving method employed in a hydraulic power unit of the invention according to the first aspect is a ram moving method employed in a hydraulic power unit controlling a double acting cylinder using a two-way pump driven by a servo motor, comprising the following steps of: issuing an instruction to move the ram: and after the instruction, suppressing a ram instructed speed to a certain warming-up speed not higher than a target speed until a speed of the ram reaches a predetermined warming-up release speed.

Therefore, if the ram moving instruction is issued, the instructed speed is instructed to be suppressed to the certain warming-up speed not higher than the target speed until the ram speed reaches the predetermined warming-up release speed. Therefore, it is possible to prevent a shock generated when the movement of the ram starts. In addition, if the ram moving speed exceeds the predetermined warming-up release speed, the warning-up speed is released and the ram is accelerated to the target speed. It is, therefore, possible to eliminate ram moving dead time and to reach the target speed in the shortest time.

A ram moving method of the invention according to a second aspect dependent on the first aspect is characterized in that the ram instructed speed is suppressed to the certain warming-up speed not higher than the target speed for certain time after the ram moving instruction.

Therefore, the ram instructed speed is suppressed to the certain warming-up speed not higher than the target speed for certain time after the ram moving instruction. Due to this, even if the ram moving dead time changes at the start of the movement of the ram, it is possible to prevent the shock at the start of the movement of the ram. In addition, since the warning-up speed is released and the ram is accelerated to the target if the certain time passes and the ram moving speed exceeds the predetermined warming-up release speed, it is possible to eliminate the ram moving dead time and to reach the target speed in the shortest time.

A ram moving method of the invention according to a third aspect dependent on the first or second aspect is characterized in that the ram moving speed is detected from a change in a position signal from ram position detection means (section) for detecting a position of this ram.

Therefore, by detecting the ram moving speed based on which the warming-up speed is released, from a change in the ram position detected by the rain position detection means, it is possible to determine whether to release the warming-up speed.

A ram moving method of the invention according to a fourth aspect dependent on any one of the first to third aspects is characterized in that the ram moving speed is detected from a ram position deviation between the position signal from the ram position detection means for detecting the position of this ram and an instructed value or a change in this ram position deviation.

Therefore, by detecting the ram moving speed based on which the warming-up speed is released, from a change in the ram position deviation between the position signal from the ram position detection means for detecting the position of the ram and the instructed value or a change in this ram position deviation, it is possible to determine whether to release the warming-up speed.

A ram moving method of the invention according to a fifth aspect dependent on any one of the first to fourth aspects is characterized in that the ram moving speed is detected from internal pressure of a control-side cylinder.

Therefore, by detecting the ram moving speed based on which the warming-up speed is released, from a detected change in the internal pressure of a control-side cylinder, it is possible to determine whether to release the warming-up speed.

A ram moving method of the invention according to a sixth aspect dependent on any one of the first to fifth aspects is characterized in that the ram moving speed is detected from a change in an instruction of a number of revolutions of the servo motor.

Therefore, by detecting the ram moving speed based on which the warming-up speed is released, from a change in the instruction of the number of revolutions of the servo motor driving the two-way pump, it is possible to determine whether to release the warming-up speed.

A ram moving controller in a hydraulic power unit of the invention according to a seventh aspect is a ram controller in a hydraulic power unit controlling a double acting cylinder using a two-way pump driven by a servo motor, comprising: a speed distribution processing section controlling the servo motor so as to move the ram according to a ram moving pattern; a ram moving speed calculation section calculating a moving speed of the ram; and a release speed determination section determining whether or not the speed of the ram exceeds a preset warming-up release speed, wherein with the configuration, the speed distribution processing section suppresses a ram instructed speed to a certain warming-up speed not higher than a target ram speed until the release speed determination section determines that the ram moving speed exceeds the warming-up release speed, and if the release speed determination section determines that the ram moving speed exceeds the warming-up release speed, an instruction is issued so as to accelerate the ram to the target ram speed.

Therefore, if the ram moving instruction is issued from the speed distribution processing section according to a ram moving pattern, the ram instructed speed is instructed to be suppressed to the certain warming-up speed not higher than the target speed until the release speed determination section determines that the ram moving speed calculated by the ram moving speed calculation section reaches the predetermined warming-up release speed. Therefore, it is possible to prevent a shock generated when the movement of the ram starts. In addition, if the release speed determination section determines that the ram moving speed calculated by the ram moving speed calculation section exceeds the predetermined warming-up release speed, the warming-up speed is released and the ram is accelerated to the target speed.

A ram moving controller in a hydraulic power unit of the invention according to an eighth aspect dependent on the seventh aspect further comprises: a timer measuring time since start of moving the ram, wherein with the configuration, the speed distribution processing section issues an instruction so as to suppress the ram instructed speed to the certain warming-up speed not higher than the target ram speed until the timer counts predetermined time, irrespectively of a determination of the release speed determination section.

Therefore, even if the release speed determination section determines that the ram moving speed reaches the warming-up speed, the ram instructed speed is instructed to be suppressed to the certain warming-up speed not higher than the target speed until the certain time passes in the timer after the ram moving instruction. If this certain time passes and the ram moving speed is determined to exceed the predetermined warming-up release speed, then the warming-up speed is released and the ram is accelerated to the target speed. Therefore, it is possible to eliminate ram moving dead time and to reach the target speed in the shortest time.

A ram moving controller in a hydraulic power unit of the invention according to a ninth aspect dependent on the seventh or eighth aspect further comprises a ram moving speed calculation section detecting the moving speed of the ram from a change in a position signal from ram position detection means for detecting a position of this ram.

Therefore, by the ram moving speed calculation section's detecting the ram moving speed based on which the warming-up speed is released, from a change in the ram position detected by the ram position detection means, it is possible to determine whether to release the warming-up speed.

A ram moving controller in a hydraulic power unit of the invention according to a tenth aspect dependent on any one of the seventh to ninth aspects further comprises: a ram moving speed calculation section detecting from a ram position deviation between the position signal from the ram position detection means for detecting the position of this ram and an instructed value or a change in this ram position deviation.

Therefore, by the ram moving speed calculation section's detecting the ram moving speed based on which the warming-up speed is released, from a change in the ram position deviation between the position signal from the ram position detection means for detecting the position of the ram and the instructed value or a change in this ram position deviation, it is possible to determine whether to release the warming-up speed.

A ram moving controller in a hydraulic power unit of the invention according to an eleventh aspect dependent on any one of the seventh to tenth aspects further comprises: a ram moving speed calculation section detecting the ram moving speed from internal pressure of a control-side cylinder.

Therefore, by the ram moving speed calculation section's detecting the ram moving speed based on which the warming-up speed is released, from the internal pressure of a control-side cylinder, it is possible to determine whether to release the warming-up speed.

A ram moving controller in a hydraulic power unit of the invention according to a twelfth aspect dependent on any one of the seventh to eleventh aspects further comprises: a ram moving speed calculation section detecting the ram moving speed from a change in an instruction of a number of revolutions of the servo motor.

Therefore, by the ram moving speed calculation section's detecting the ram moving speed based on which the warming-up speed is released, from a change in the instruction of the number of revolutions of the servo motor, it is possible to determine whether to release the warming-up speed.

An axial plunger pump confinement prevention method of the invention according to a thirteenth aspect comprises the following steps of: slightly rotating a valve plate in a rotation direction of a cylinder block of the axial plunger pump; and overlapping a part of a discharge port provided at the valve plate with a top dead center position of a plunger, thereby preventing confinement at the top dead center position of the plunger.

An axial plunger pump of the invention according to a fourteenth aspect comprises: a cylinder block having a plurality of plungers included therein to be able to be reciprocated, the cylinder block provided rotatably: and a valve plate having a circular arc-shaped discharge port and a circular arc-shaped suction port formed therein, wherein with the configuration, the valve plate is provided to be slightly rotatable in a rotation direction of the cylinder block when the rotation direction of the cylinder block is changed.

According to the axial plunger pump confinement prevention method and the axial pump plunger therefor of the present invention, the valve plate is provided to be slightly rotatable in the rotation direction of the driving shaft and the cylinder block and the top dead center position of the plunger is overlapped with a part of the discharge-side port. It is, therefore, possible to provide an axial plunger pump confinement prevention method and a pump therefor capable of preventing the confinement phenomenon at the top dead center position and capable of effectively preventing vibration and preventing noise.

BEST MODES FOR CARRYING OUT THE INVENTION

Embodiments of this invention will be described hereinafter in detail based on the drawings.

Figure 2:
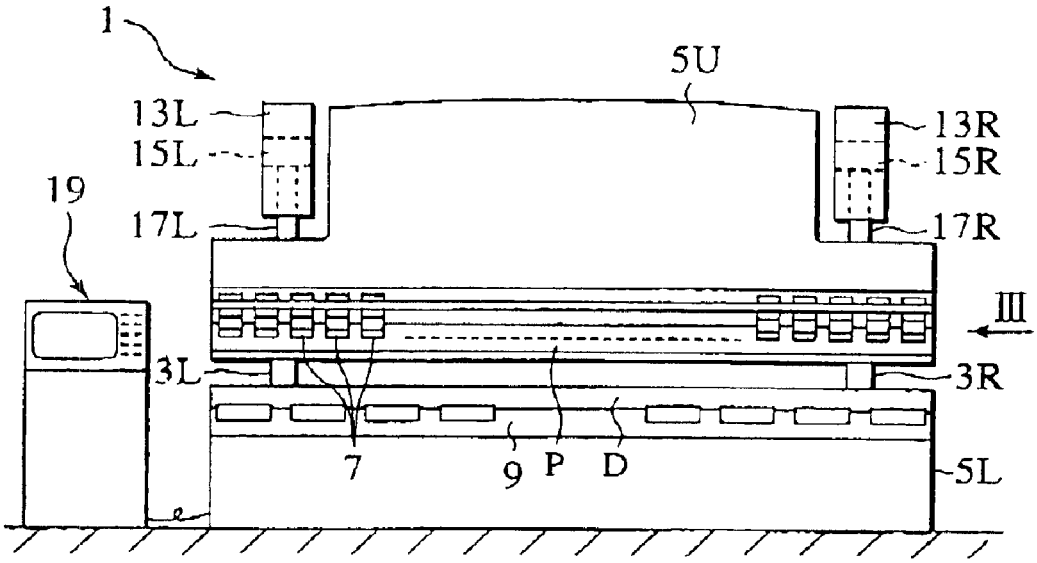
FIG. 2 is a front view showing an entire press brake as one example of the hydraulic power unit.
Figure 3:
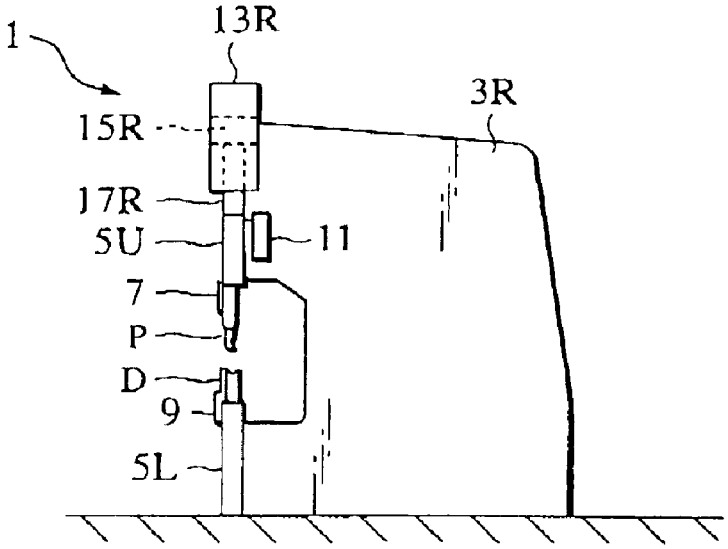
FIG. 3 is a side view of the press brake viewed from a direction III of FIG. 2.

FIG. 2 and FIG. 3 show an overall oil hydraulic press brake 1 as one example of a hydraulic power unit. This press brake has side plates 3L and 3R at left and right sides respectively, an upper table 5U, which serves as a ram, vertically movably provided on the upper front end surfaces of the side plates 3L and 3R, and a lower table fixed to the lower front surfaces of the side plates 3L and 3R.

A punch P is provided on the lower end portion of the upper table 5U through intermediate plates 7 in an exchangeable manner. In addition, a die D is provided on the upper end portion of the lower table 5L through a die base 9 in an exchangeable manner It is noted that a linear scale 11 which serves as a ram position detection means for measuring the height position of the upper table 5U is provided, so that the distance between the upper table 5U and the die D can be obtained using the heights of the intermediate plates 7 and the punch P which are known.

Hydraulic cylinders 13L and 13R are provided on the upper front surfaces of the left and right side plates 3L and 3R, respectively. The upper table 5U is attached to piston rods 17L and 17R, which are attached to pistons 15L and 15R of the hydraulic cylinders 13L and 13R, respectively. Further, a controller 19, which controls the movement of the upper table 5U and the like, is provided adjacent the press brake 1 as will be described later in detail.

Figure 1:
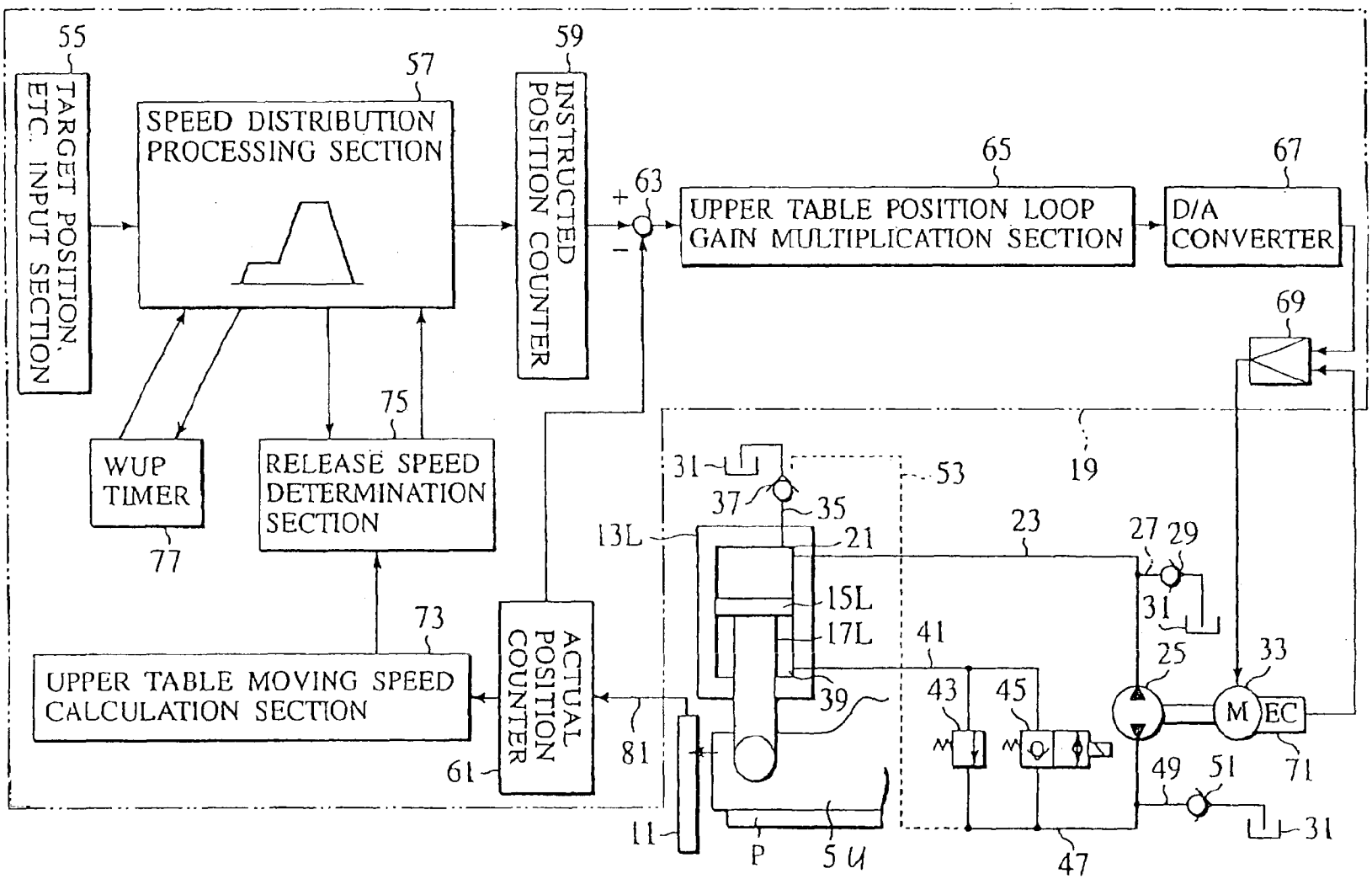
FIG. 1 is a block diagram showing a ram moving controller in a hydraulic power unit according to the present invention.

Next, the hydraulic circuit and the controller 19 which carry out a ram moving method according to this invention will be described with reference to FIG. 1. It is noted that exactly the same hydraulic circuit is provided for each of the left and right hydraulic cylinders 13L and 13R, only the hydraulic circuit for the left-side hydraulic cylinder 13L will be described hereinafter.

A cylinder head-side cylinder chamber 21 of the hydraulic cylinder 13L which vertically moves the upper table 5U serving as a ram, is connected to one side of a two-way pump 25 through a piping 23. An axial plunger pump is optimum as the two-way pump 25 and the detailed configuration of which will be described later.

A piping 27 is connected halfway along the piping 23, and is connected to an oil tank 31 through a check valve 29. It is noted that the two-way pump 25 is actuated by a servo motor 33. Further, the cylinder head-side cylinder chamber 21 is connected to an oil tank 31 through a pre-fill valve 37 by a piping 35.

On the other hand, a rod-side cylinder-side piping 41 is connected to a rod-side cylinder chamber 39 of the hydraulic cylinder 13L, and a counterbalance valve 43 and a speed switching valve 45 are provided in parallel at the piping 41. The counterbalance valve 43 and the speed switching valve 45 are connected to the other side of the two-way pump 25 by a two-way pump-side piping 47.

Furthermore, a piping 49 is connected halfway along the two-way pump-side piping 47 and this piping 49 is connected to the oil tank 31 through a check valve 51.

With the above-stated configuration, if the two-way pump 25 is rotated in a forward direction by the rotation of the servo motor 33 to thereby supply hydraulic oil from the oil tank 31 to the cylinder head-side cylinder chamber 21 through the check valve 51, the piping 49 and the piping 23, the piston 15L lowers to thereby lower the upper table 5U and the punch P.

On the other hand, if the two-way pump 25 is rotated in a counter direction by the servo motor 33, then the hydraulic oil is supplied from the oil tank 31 to the rod-side cylinder chamber 39 through the check valve 29, the piping 27, the two-way pump-side piping 47, a check valve of the speed switching valve 45 and the cylinder-side piping 41 and the piston rod 17L rises to thereby raise the upper table 5U and the punch P.

It is noted that the upper and lower positions of the upper table 5U are detected by the linear scale 11. In addition, if the pressure of the rod-side cylinder chamber 39 is higher than a predetermined value, the pre-fill valve 37 opens in response to a pilot signal 53 and the hydraulic oil is fed from the cylinder head-side cylinder camber 21 directly to the oil tank 31 through the pre-fill valve 37.

The controller 19 is provided with an input means (section) 55 for inputting a target position and the like, i.e., for inputting various parameters for a movement instruction such as the target position and moving speed of the upper table 5U serving as a ram, and a ram speed distribution processing section 57 instructs the moving pattern of the upper table 5U according to the parameters input by the target position, etc. input means 55. Further, an instructed position counter 59 reads an instructed position of the upper table 5U from an instruction signal from this ram speed distribution processing section 57.

On the other hand, an actual position counter 61 reads and feeds back an actual position signal from the linear scale 11 which detects the positions of the upper table 5U as indicated by a line 81, and an adder 63 adds up this fed-back signal and the instructed position read by the instructed position counter 59. An upper table position loop gain multiplication section 65 multiplies the value added by this adder 63 by an upper table position loop gain.

Furthermore, this signal is D/R converted by a D/A converter 67 and transmitted to the servo motor 33 through a servo amplifier 69. It is noted that a rotary encoder 71 is attached to the servo motor 33 so that the number of revolutions of the servo motor 33 is fed back to the servo amplifier 69 to hold a predetermined number of revolutions.

It is noted that an upper table moving speed calculation section 73 which calculates the moving speed of the upper table 5U is connected to the actual position counter 61, and a release speed determination section 75 which determines whether or not the moving speed of the upper table 5U calculated by the upper table moving speed calculation section 73 exceeds a preset warming-up release speed VFW is connected to upper table moving speed calculation section 73 and the speed distribution processing section 57. Further, a warming-up timer 77 (which is denoted as "WUP timer" in the figure) is connected to the speed distribution processing section 57 as a timer which measures warming-up time WT.

Figure 4:
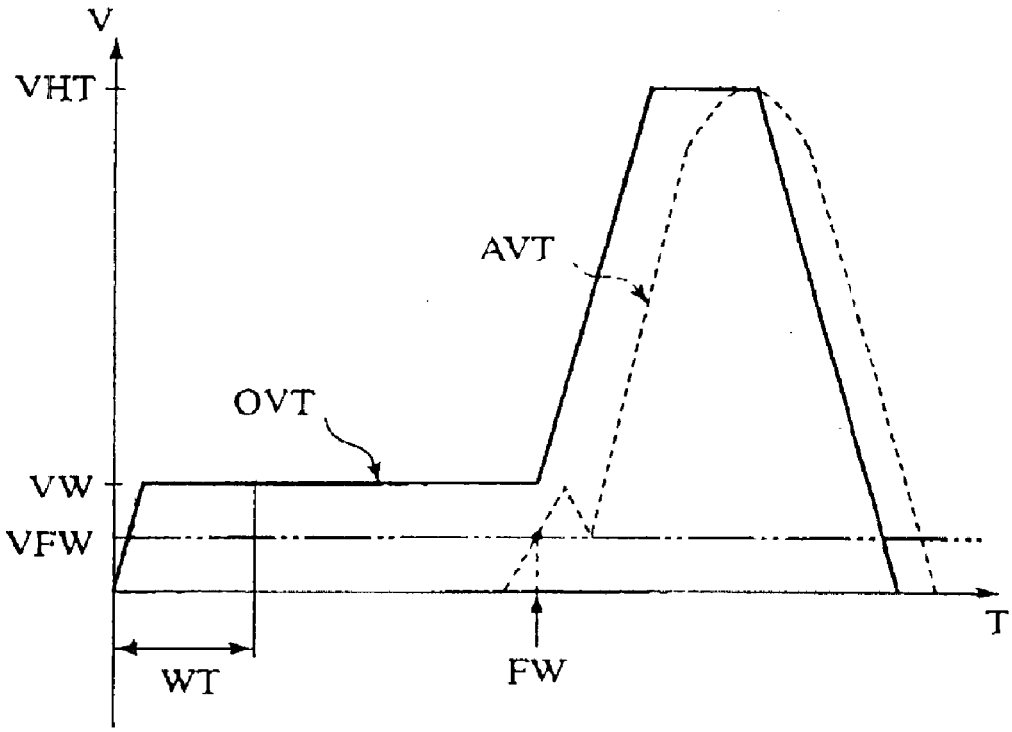
FIG. 4 is a time chart showing the moving state of an upper table which serves as a ram for the ram moving method in the hydraulic power unit according to the present invention.

Next, the processing contents of the speed distribution processing section 57 will be described with reference to FIG. 4. In FIG. 4, a vertical axis represents speed V and a horizontal axis represents time T.

The speed distribution processing section 57 moves the upper table 5U according to the table moving pattern at an instructed speed. Namely as indicated by a solid line in FIG. 4, according to the table moving pattern OVT based on the instructed speed, when the movement of the upper table 5U which is stopped starts (distribution starts), the instructed speed is accelerated to a warming-up speed VW.

Here, the warming-up speed VW is a parameter which indicates the instructed speed of the upper table 5U when warming up. The warming-up release speed VFW is expressed with a percentage (%), for exam pie, as "100%", which equals a target highest speed of the upper table 5U. In addition, the warming-up speed MW is held for a fixed time (WT), the warming-up speed is released thereafter and the moving speed is instructed to be accelerated to a target highest speed VHT.

However, since the pressure of the hydraulic cylinder 13L when the movement starts is in a negative pressure state in the hydraulic circuit which employs the two-way pump 25, dead time occurs so as to drive the two-way pump 25 using the servo motor 33, to supply the hydraulic oil to the hydraulic cylinder 13L and to move the upper table 5U.

Figure 5:
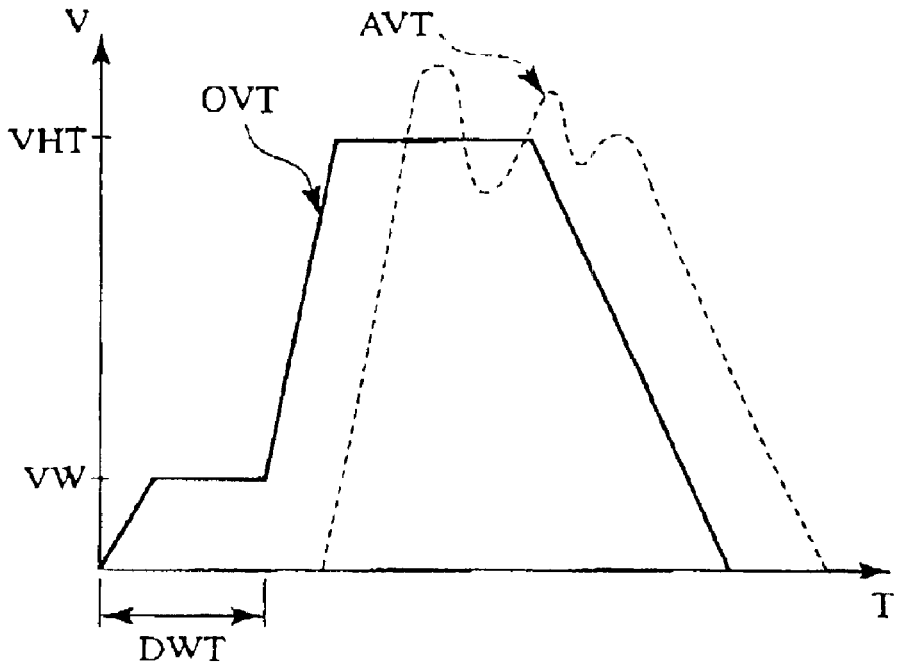
FIG. 5 is a time chart showing the moving state of the upper table for explaining the present invention.
Figure 6:
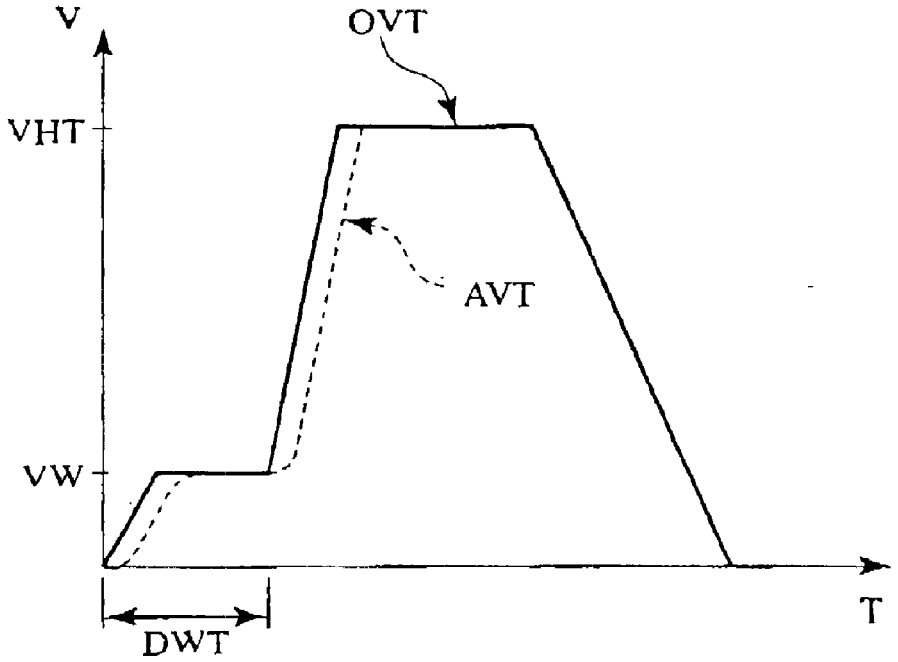
FIG. 6 is a time chart showing the moving state of the upper table for explaining the present invention.

This dead time changes according to the pressure state (which is not necessarily the negative pressure state) of the hydraulic cylinder 13L when the movement starts. Due to this, if the upper table 5U is warmed up for warming-up time DWT which is fixed and the dead time is long as shown in a diagram indicated by a broken line in FIG. 5, a shock is generated and an upper table actual speed AVT changes like a wave Further, as shown in FIG. 6, if the dead time is short, the actual speed AVT of the upper table 5U, it takes longer time to reach the highest speed VHT. In the ram moving method according to this invention, therefore, a warming-up release speed VFW indicated by a two-dot chain line in FIG. 4 is set as a threshold. Further, as shown in the moving pattern of the actual speed AVT of the upper table 5U indicated by a broken line in FIG. 4, the warming up of the upper table 5U is released (at a position indicated by reference symbol FW in FIG. 4) if the actual moving speed AVT of the upper table 5U obtained from a change in the position of the upper table 5U detected by the linear scale 11 exceeds the warming-up release speed VFW.

Here, the warming-up time is a parameter indicating time which is counted by the warming-up timer 77 and for which time the upper table 5U is warmed up since the start of the distribution, and is set in a range of, for example, 0 to 9.99 sec. Further, the warming-up release speed VFW is an instructed speed of the upper table 5U which serves as a threshold for releasing warming up. The warming-up release speed VFW is expressed with as a percentage (%), with 100% equaling the warming-up speed VW.

It is noted, however, the actual speed AVT of the upper table 5U is sometimes unstable when the distribution starts such as after switching the speed switching valve 45. Due to this, for certain time set to the WUP timer 77 after the start of distribution, i.e., until warming up ends, even if the actual speed of the upper table 5U exceeds the warming-up speed serving as a threshold, the warming up is not released but the clamping of the warming-up speed is continued.

The warming-up time set to the warming-up timer 77 is counted. In addition, if the actual moving speed AVT of the upper table 5U exceeds the warming-up release speed VFW, then the warming up of the upper table 5U is released and the instructed speed DVT of the upper table 5U is accelerated to the target highest speed VHT.

Judging from the above result, even if the dead time of the movement of the upper table 5U at the state of distribution changes depending on an operating state Dust before the start of distribution, it is possible to move the upper table 5U in the shortest time without generating a shock.

It is noted that this invention is not limited to the above-stated embodiment but can be carried out in other embodiments by appropriately changing the invention. Namely, the speed of the upper table 5U is judged from the positions of the upper table 5U which is detected by the linear scale 11 in the embodiment stated above. Alternatively, the speed of the upper table 5U can be judged from the position deviation of the upper table 5U, a change in the position deviation of the upper table 5U, the internal pressure of the control-side cylinder detected by the oil pressure sensor provided in the head-side cylinder chamber 21 or the rod-side cylinder chamber 39 of each of the hydraulic cylinders 13L and 13R, a change in the rotation instruction of the servo motor 33 or the like other than the position signal of the upper table 5U.

Next, as an embodiment in which an axial plunger pump optimum for the two-way pump 25 which is employed in the first embodiment stated above is employed, an axial plunger pump 101 will be described in detail with reference to FIG. 7 to FIG. 9.

Figure 7:
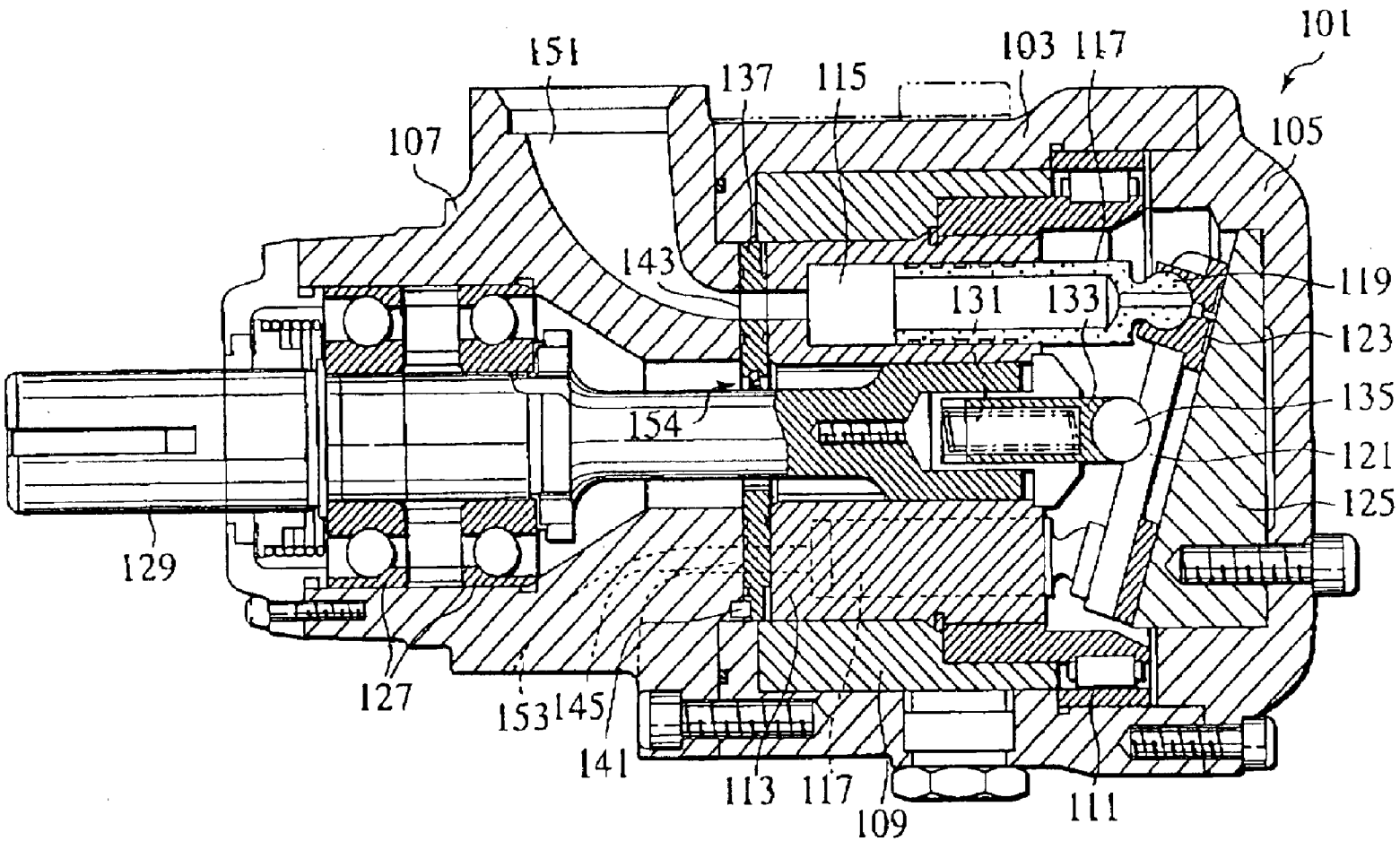
FIG. 7 is a sectional explanatory view of a plunger pump according to an embodiment of the present invention.

As shown in FIG. 7, the axial plunger pump 101 in this embodiment is constituted so that an inclined plate casing 105 is fixed to one end of a cylindrical cylinder block casing 103 and a bearing casing 107 is fixed to the other end thereof.

A cylindrical member 109 is fixedly fitted into the cylinder block casing 103, and a cylinder block 113 is rotatably fitted into and supported in this cylindrical member 109 through a bearing 111. A plurality of plunger insertion holes 115 are equidistantly provided on the same circumference of this cylinder block 113, and a plunger (piston) 117 is slidably fitted into each of the plunger insertion holes 115 in a direction in which the plunger 117 goes in and out.

The tip end of the plunger 117 is spherical, and the spherical head portion 119 of this plunger 117 is slidably, rotatably supported by a shoe 123 supported by a disk-like presser plate 121. The presser plate 121 slidably contacts with the inclined surface of the inclined plate 125 fixed into the inclined plate casing 105.

To rotate the cylinder block 113, a driving shaft 129 is rotatably supported by the bearing casing 107 through a bearing 127, and the tip end portion of this driving shaft 129 is appropriately connected to the cylinder block 113. Further, a plunger 133 which is urged in a protruding direction by a spring 131 is provided on the tip end portion of the driving shaft 129. This plunger 133 presses the presser plate 121 against the inclined surface of the inclined plate 125 through a ball 135 provided on the tip end portion of the plunger 133.

A circular valve plate 137 is provided between the bearing casing 107 and the cylinder block 113. The movement of this valve plate 137 is restricted by engaging a pin 141 provided at the valve plate 137 with a pin engagement hole 139 (see FIG. 9) provided in the bearing casing 107. As shown in FIG. 8, the valve plate 137 is provided with a circular arc-shaped suction port 143 and a circular arc-shaped discharge port 145.

The suction port 143 and the discharge port 145 are formed in an elongated manner between a top dead center position 147 (a left end position in FIG. 7: the position of the plunger 117 indicated by a broken line on the lower side of FIG. 7) at which the plunger 117 is in an engaged state in which the plunger 117 is fitted into the plunger insertion hole 115 of the cylinder block 113 most deeply and a bottom dead center position 149 (a right end position in FIG. 7; the position of the plunger 111 indicated by a solid line on the upper side of FIG. 8) at which the plunger 117 is in an engaged state in which the plunger 117 is fitted into the plunger insertion hole 115 most shallowly. It is noted that the suction port 143 and the discharge port 145 are defined based on the actions and functions of the ports if the cylinder block 113 is rotated in a clockwise direction in FIG. 8 and so named, respectively. However, the suction and discharge functions thereof replace each other if the cylinder block 113 is rotated in a counter direction.

A suction port of the plunger pump 151 and a the discharge port of the plunger pump 153, which correspond to the suction port of the valve plate 143 and the discharge port of the valve plate 145, respectively, are formed in the bearing casing 107. The functions of the suction port 151 and the discharge port 153 replace each other if the cylinder block 113 is rotated in the counter direction.

Figure 8:
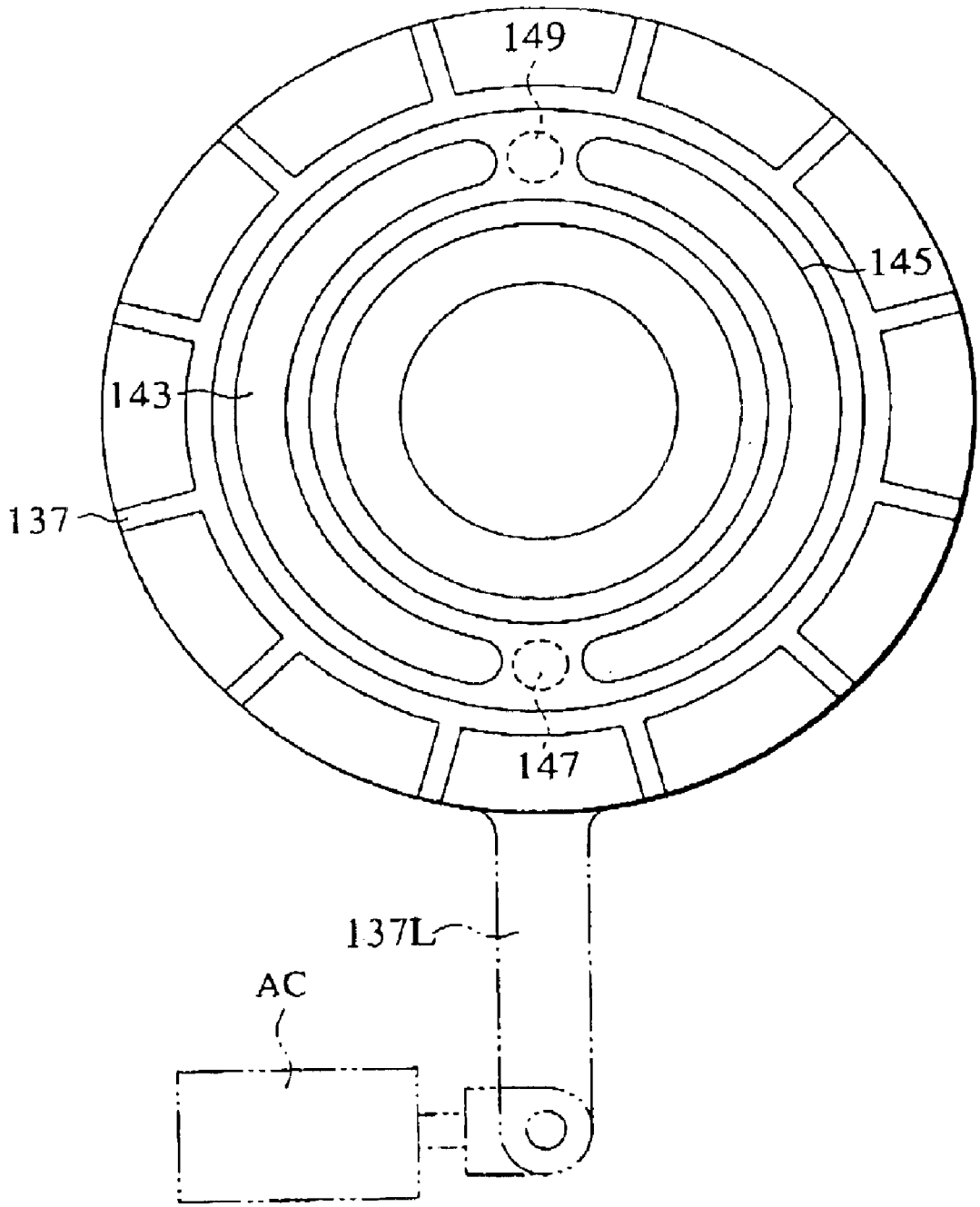
FIG. 8 is an explanatory view of a valve plate.

With the above-stated configuration, if the cylinder block 113 is rotated in a clockwise direction in FIG. 8 (which does not show the cylinder block) by the forward rotation of the driving shaft 129, then the plunger 117 is rotated from the top dead center position 147 (a lowermost end in FIG. 8) to the bottom dead center position 149 (an uppermost end in FIG. 8) and thereby moves right in FIG. 7. Hydraulic oil is sucked in the plunger insertion hole 115 of the cylinder block 113 from the suction ports 143 and 151. Further, as the plunger 117 is rotated from the bottom dead center position 149 to the top dead center position 147, the plunger 117 moves left in FIG. 7 and the hydraulic oil in the plunger insertion hole 115 is discharged from the discharge ports 145 and 153.

If the driving shaft 129 rotates in a counter direction, the cylinder block 113 is rotated in the counter direction, whereby the cylinder block 113 is rotated counterclockwise in FIG. 8, the hydraulic oil is sucked from the discharge port 145 and discharged from the suction port 143. That is, a hydraulic oil flow direction is reversed if the driving shaft 129 is rotated in a forward or counter direction and the suction and discharge functions of the suction port 143 and the discharge port 145 replace each other. The following description is based on the clockwise direction.

Meanwhile, if the plunger 117 is rotated and slid to the top end dead position 147, the plunger 117 is located at the position indicated by the broken line of FIG. 8 (147) and the plunger insertion hole 115 does not, therefore, communicate with the discharge port 145 and the suction port 143 but is closed. Therefore, a small quantity of hydraulic oil which is not completely discharged to the discharge port 145 and is left in the plunger 117 is in a confined state (to be referred to as "confinement phenomenon" hereinafter). While maintaining this state, the plunger 117 further, slightly moves left in FIG. 7 by the inclination of the inclined plate 125 to the left end (top dead center), so that high pressure is generated in the plunger 117.

The instance the cylinder block 113 is slightly rotated and communicates with the suction port 143, the high pressure is suddenly released, with the result that vibration and noise are generated during the release.

In this embodiment, therefore, the valve plate 137 is constituted to be slightly rotated in the same direction as the rotation direction of the driving shaft 129, whereby the top dead center position 147 is communicated with the discharge port 145 (which becomes the suction port 143 during the counter rotation) and the confinement phenomenon is prevented at the top dead center position 147.

Figure 9:
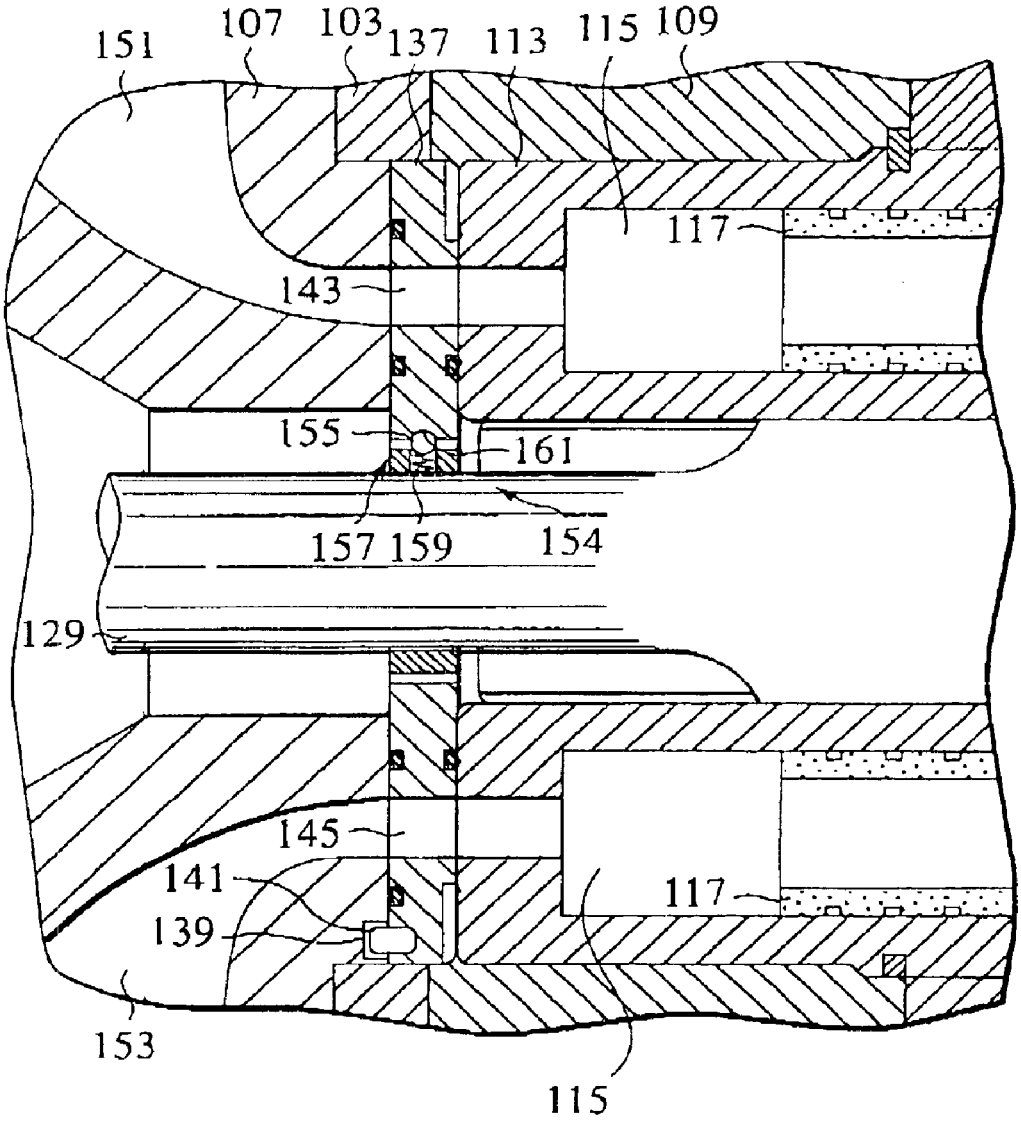
FIG. 9 is an enlarged explanatory view of important parts of the valve plate shown in FIG. 7.

That is, as shown in FIG. 9 in detail, the pin engagement hole 139 with which the pin 141 is engaged is formed to be slightly larger or elongated in a circular arc shape, the valve plate 137 is constituted to be slightly rotatable and the rotation range of this valve plate 137 is specified by restricting the pin 141 by the pin engagement hole 139 as shown in FIG. 9 in detail. It is noted that the rotation range of the valve plate 137 means a range in which high pressure generated by the confinement phenomenon at the top dead center position 147 is prevented by allowing the end portion of the discharge port 145 to be slightly spread to the top dead center position 147 if the cylinder block 113 is rotated in the forward direction by the forward rotation of the driving shaft 129 and by allowing the end portion of the suction port 143 to be slightly spread to the top dead center position 147 if the cylinder block 113 is rotated in the counter direction.

A frictional engagement means (section) 154 is provided to cause appropriate friction between the driving shaft 129 and the valve plate 137 to thereby rotate the valve plate 137 in the rotation direction of the driving shaft 129 More specifically, as one example of the fractional engagement means 154, ball plungers 157 each of which is urged by a spring 159 or the like in a direction in which a ball 155 serving as a stopper member protrudes are provided in an appropriate number of portions of the driving shaft 129, and the ball 155 is engaged with a groove-like or hole-like engagement section 161 which is formed over an appropriate range on the inner peripheral surface of the valve plate 137 to be able to engaged and disengaged. It is noted that the stopper member 155 and the stopper section 161 are relative to each other so that the stopper member 155 may be formed on the inner peripheral surface side of the valve plate 137 and the stopper section 161 may be formed on the driving shaft 129 side.

With the above-stated configuration, if the driving shaft 129 is rotated in a forward direction, the frictional engagement means 154 acts, i.e., the ball 155 serving as the stopper member is engaged with the stopper section 161 and the valve plate 137 is, therefore, rotated in the rotation direction of the driving shaft 129. However, if the valve plate 137 is slightly rotated in this rotation direction, the pin 141 provided at the valve plate 137 abuts on the pin engagement hole 139 and stops the rotation of the valve plate 137. Thereafter, since the ball 155 is detached from the engagement section 161, the valve plate 137 is stopped at the position at which the valve plate 137 is slightly rotated as stated above. Conversely, if the driving shaft 129 is rotated in a counter direction, the valve plate 137 is slightly rotated in the counter direction according to the rotation of the driving shaft 129.

Therefore, if the driving shaft 129 and the cylinder block 113 are rotated in the forward direction, then the valve plate 137 is slightly rotated clockwise in Pig. 8, the lower side end portion of the discharge port 145 in FIG. 8 slightly spread to the top dead center position 147 and the discharge port 145 is communicated with the top dead center position 147, thereby making it possible to avoid the confinement phenomenon stated above. Conversely, if the driving shaft 129 and the cylinder block 113 are rotated in the counter direction, then the valve plate 137 is slightly rotated counterclockwise in FIG. 8, the end portion of the suction port 143 slightly spreads to the top dead center position 147 and the suction port 143 is communicated with the-top dead center position 147, thereby making it possible to avoid the confinement phenomenon at the top dead center position 147 while the cylinder block 113 is rotate in the counter direction by the counter rotation of the driving shaft 129. Accordingly, it is possible to prevent the generation of vibration and noise caused by the confinement phenomenon.

It is noted that the present invention is not limited to the above-stated embodiment but can be carried out in other embodiments by appropriately changing the invention That is, as indicated by an imaginary line in FIG. 8, a lever 137L may be provided at the valve plate 137, the lever 137L may be protruded outward from a slit (not shown) formed in the casing, and the valve plate 137 may be slightly rotated in a forward or counter direction using an actuator such as a small-sized hydraulic cylinder or a solenoid, moved with and coupled to this lever 137L.

If the pump is so constituted, it is possible to rotate the valve plate 137 with a high force and to ensure rotating the valve plate 137.

Further, as another embodiment, the inclined plate 125 can be made not flat but curved like a cam plate. That is, if the plunger 117 is located near the top dead center, the inclined surface at a position at which the plunger 117 is located is partially formed to have a vertical surface in FIG. 8, whereby even if the plunger 117 is located near the top dead center, it is not move left further in FIG. 7. Therefore, even if the confinement phenomenon occurs, it is possible to stop the internal pressure of the plunger 117 from rising.

While the inclined plate type axial plunger pump has been exemplified above, the present invention can easily carried out by an inclined shaft type axial plunger pump.

What is claimed is:

1. A ram moving method employed in a hydraulic power unit that controls a double acting cylinder using a two-way pump driven by a servo motor, the method comprising:

issuing an instruction to move the ram; and suppressing a ram instructed speed to a predetermined warming-up speed not higher than a target ram speed, until a speed of the ram reaches a predetermined warming-up release speed.

2. The ram moving method according to claim 1, wherein the ram instructed speed is suppressed to the predetermined warming-up speed for a predetermined time after the instruction to move the ram is issued.

3. The ram moving method according to claim 2, wherein the speed of the ram is detected based on a change in a position signal of a ram position detector that detects a position of the ram.

4. The ram moving method according to claim 3, wherein the speed of the ram is detected from a ram position deviation between the position signal from the ram position detector and one of an instructed value and a change in the ram position deviation.

5. The ram moving method according to claim 4, wherein the speed of the ram is detected from an internal pressure of a control-side cylinder.

6. The ram moving method according to claim 5, wherein the speed of the ram is detected from a change in an instruction of a number of revolutions of the servo motor.

7. A ram moving controller in a hydraulic power unit that controls a double acting cylinder using a two-way pump driven by a servo motor, the ram moving controller comprising:

a speed distribution processor that controls the servo motor so as to move the ram according to a ram moving pattern;

a ram speed calculator that calculates a speed of the ram; and a release speed determiner that determines whether the speed of the ram exceeds a predetermined warming-up release speed, wherein the speed distribution processor suppresses a ram instructed speed to a predetermined warming-up speed not higher than a target ram speed, until the release speed determiner determines that the speed of the ram reaches the predetermined warming-up release speed, and wherein an instruction is issued so as to accelerate the speed of the ram to the target ram speed when the release speed determiner determines that the speed of the ram exceeds the warming-up release speed.

8. The ram moving controller in a hydraulic power unit according to claim 7, further comprising:

a timer that measures time from the start of moving the ram, wherein the speed distribution processor issues an instruction so as to suppress the ram instructed speed to the predetermined warming-up speed until the timer counts a predetermined time, without regard to a determination of the release speed determiner.

9. The ram moving controller in a hydraulic power unit according to claim 8, wherein:

the ram speed calculator detects the speed of the ram based upon a change in a position signal from a ram position detector that detects a position of the ram.

10. The ram moving controller in a hydraulic power unit according to claim 9, wherein:

the ram speed calculator detects the speed of the ram from a ram position deviation between the position signal from the ram position detector and one of an instructed value and a change in the ram position deviation.

11. The ram moving controller in a hydraulic power unit according to claim 10, wherein:

the ram speed calculator detects the speed of the ram based on internal pressure of a control-side cylinder.

12. The ram moving controller in a hydraulic power unit according to claim 11, wherein the ram speed calculator detects the speed of the ram from a change in an instruction of a number of revolutions of the servo motor.

* * * * *